US006354906B1

(12) United States Patent
Liu

(10) Patent No.: US 6,354,906 B1
(45) Date of Patent: Mar. 12, 2002

(54) BRASSIERE WITH ADJUSTABLE CUP SUPPORT MEANS

(76) Inventor: Shan Pu Liu, 5F-23, 70, Fu-Shing Road, Taoyuan (TW)

( * ) Notice: Subject to any disclaimer, the term of this patent is extended or adjusted under 35 U.S.C. 154(b) by 0 days.

(21) Appl. No.: 09/725,186

(22) Filed: Nov. 29, 2000

(51) Int. Cl.[7] ..... A41C 3/00
(52) U.S. Cl. ..... 450/38; 450/57; 2/267
(58) Field of Search ..... 450/37, 38, 55, 450/59; 2/267, 268, DIG. 3

(56) References Cited

U.S. PATENT DOCUMENTS

| | | | | | |
|---|---|---|---|---|---|
| 76,894 | A | * | 4/1868 | Cook | 450/38 |
| 282,627 | A | * | 8/1883 | Gensch | 450/38 |
| 599,180 | A | * | 2/1898 | Harrison | 450/57 |
| 665,260 | A | * | 1/1901 | Ostermeyer | 450/57 |
| 990,279 | A | * | 4/1911 | Mayer | 450/57 |
| 1,119,047 | A | * | 12/1914 | Simmons | 450/38 X |
| 3,326,218 | A | * | 6/1967 | McAlpine | 450/57 |
| 3,559,214 | A | * | 2/1971 | Pangman | 450/38 X |
| 3,600,718 | A | * | 8/1971 | Boone | 450/38 X |
| 5,347,656 | A | * | 9/1994 | Fabritz et al. | 450/38 |
| 6,080,037 | A | * | 6/2000 | Lee et al. | 450/38 |
| 6,132,288 | A | * | 10/2000 | Aerts | 450/38 |

* cited by examiner

*Primary Examiner*—Gloria M. Hale
(74) *Attorney, Agent, or Firm*—Troxell Law Office PLLC

(57) ABSTRACT

A brassiere having two inflatable paddings shaped like a waxing crescent and respectively installed in the two cups thereof, a connecting tube connected between the inflatable paddings, and an air inlet tube with a mouthpiece fastened to one shoulder strap thereof and connected to one inflatable padding for blowing with the mouth to inflate the inflatable paddings.

4 Claims, 8 Drawing Sheets

BRASSIERE WITH ADJUSTABLE CUP SUPPORT MEANS

BACKGROUND OF THE INVENTION

The present invention relates to brassieres, and more particularly to such a brassiere, which is stuffed with inflatable, crescent-shaped paddings to enhance the shape of the breasts.

When getting old or after a childbirth, a woman's breasts may become falling. In order to lift the falling breasts, an orthopedically engineered brassiere may be used. A variety of orthopedically engineered brassieres have been disclosed, and have appeared on the market. These designs of brassieres are adapted to lift falling breasts, or to enhance the appearance of flat breasts.

SUMMARY OF THE INVENTION

It is the main object of the present invention to provide a brassiere, which effectively lifts falling breasts, and which greatly enhances the appearance of flat breasts. According to one embodiment of the present invention, the brassiere comprises two inflatable paddings shaped like a waxing crescent and respectively installed in the two cups thereof, a connecting tube connected between the inflatable paddings, and an air inlet tube with a mouthpiece fastened to one shoulder strap thereof and connected to one inflatable padding for blowing with the mouth to inflate the inflatable paddings. According to an alternate form of the present invention, the brassiere is a strapless brassiere, and the air inlet tube is directly formed integral with the connecting tube between the two inflatable paddings in the cups. According to another alternate form of the present invention, the inflatable paddings are independently installed in the cups of the brassiere body, and two air inlet tubes are separately installed in the brassiere body and respectively connected to the inflatable paddings, enabling the inflatable paddings to be separately inflated.

DETAILED DESCRIPTION OF THE PREFERRED EMBODIMENT

Figure 1:
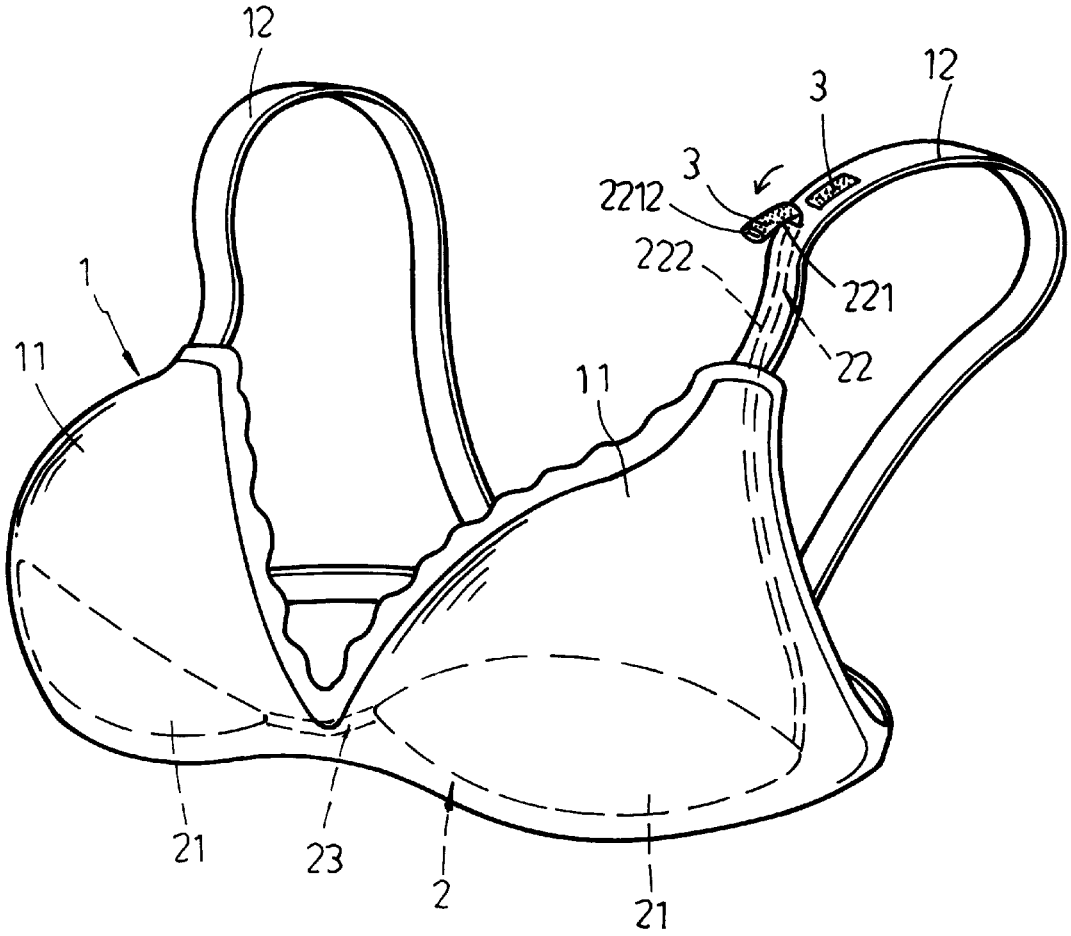
FIG. 1 is illustrates a brassiere constructed according to the present invention.
Figure 2:
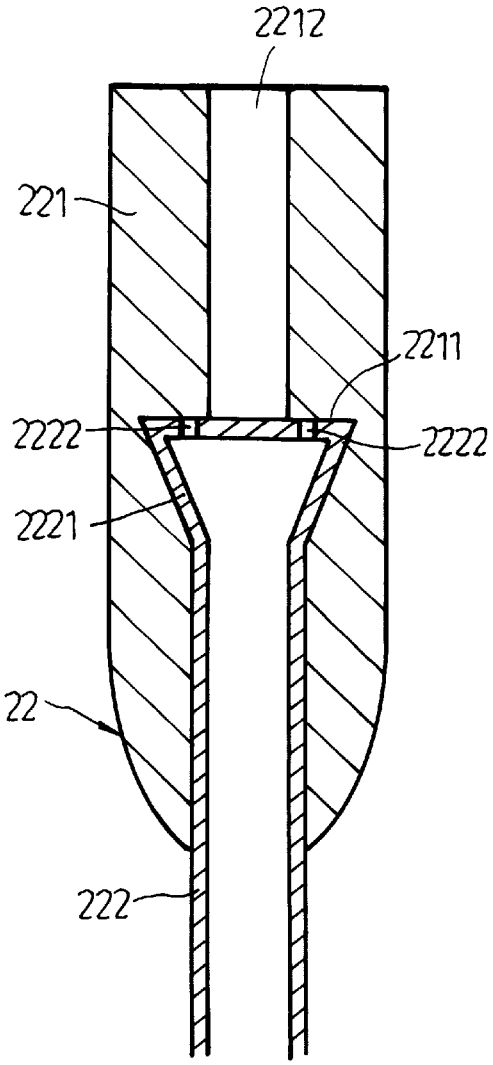
FIG. 2 is a sectional view of an air inlet tube according to the present invention, showing the air inlets closed.

Referring to FIGS. 1 and 2, a brassiere 1 in accordance with the present invention comprises a brassiere body 1 having two cups 11, and an adjustable cup support device 2 installed in the cups 11 of the brassiere body 1. The adjustable cup support device 2 comprises two inflatable paddings 21 shaped like the waxing crescent and respectively mounted in the cups 11 at a lower side, a connecting tube 23 mounted in the brassiere body 1 and connected between the inflatable paddings 21, and an air inlet tube 22 extended from one inflatable padding 21 to the outside of the brassiere body 1. The inflatable paddings 21 are molded from silicon rubber or similar material. The air inlet tube 22 comprises a mouthpiece 221 defining a blowhole 2212 through which air is blown into the inflatable paddings 21.

Figure 3:
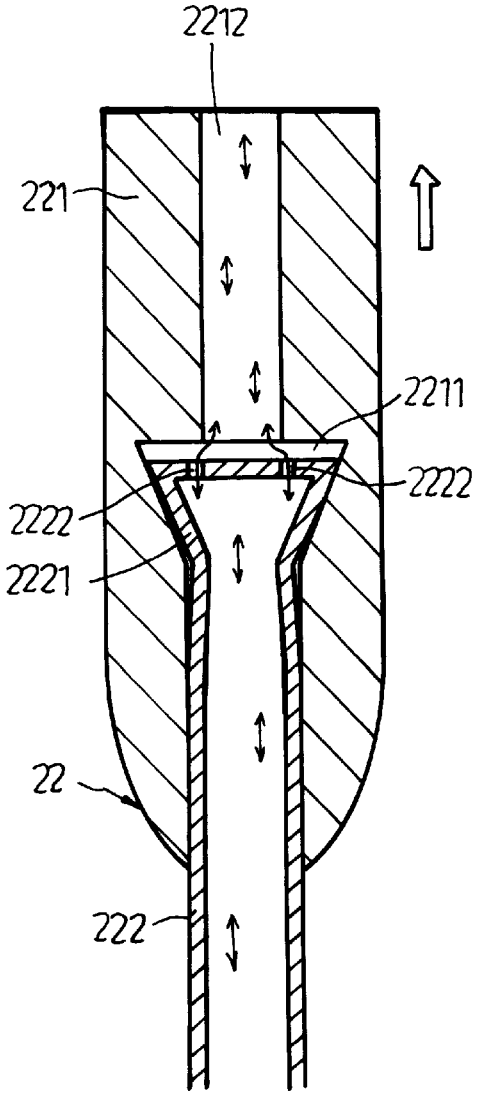
FIG. 3 is similar to FIG. 2 but showing the air inlets opened.

Referring to FIG. 3 and FIG. 2 again, the air inlet tube 22 is embedded in one shoulder strap 12 of the brassiere body 1, comprising a tube 222 and a mouthpiece 221 coupled to one end of the tube 222. The mouthpiece 221 comprises a center conical coupling chamber 2211, and a blowhole 2212 longitudinally extended through the conical coupling chamber 2211. The tube 222 is a flat pipe of flexible member inserted into the blowhole 2212 of the mouthpiece 221 from one end, having a closed conical positioning endpiece 2221 coupled to the center conical coupling chamber 2211 and two air inlets 2222 bilaterally disposed in the endpiece 221 outside the path of the blowhole 2212. When assembled, the mouthpiece 221 can be moved axially on the tube 222 within a limited distance between the first position where the air inlets 2222 are stopped by a peripheral wall of the center conical coupling chamber 2211 and air is stopped from passing between the tube 222 and the blowhole 2212 (see FIG. 2), and the second position where the air inlets 2222 are opened and air is allowed to pass between the blowhole 2212 and the tube 222 (see FIG. 3). Further, hook and loop materials 3 are provided to secure the mouthpiece 221 to one shoulder strap 12 of the brassiere body 1.

Figure 4:
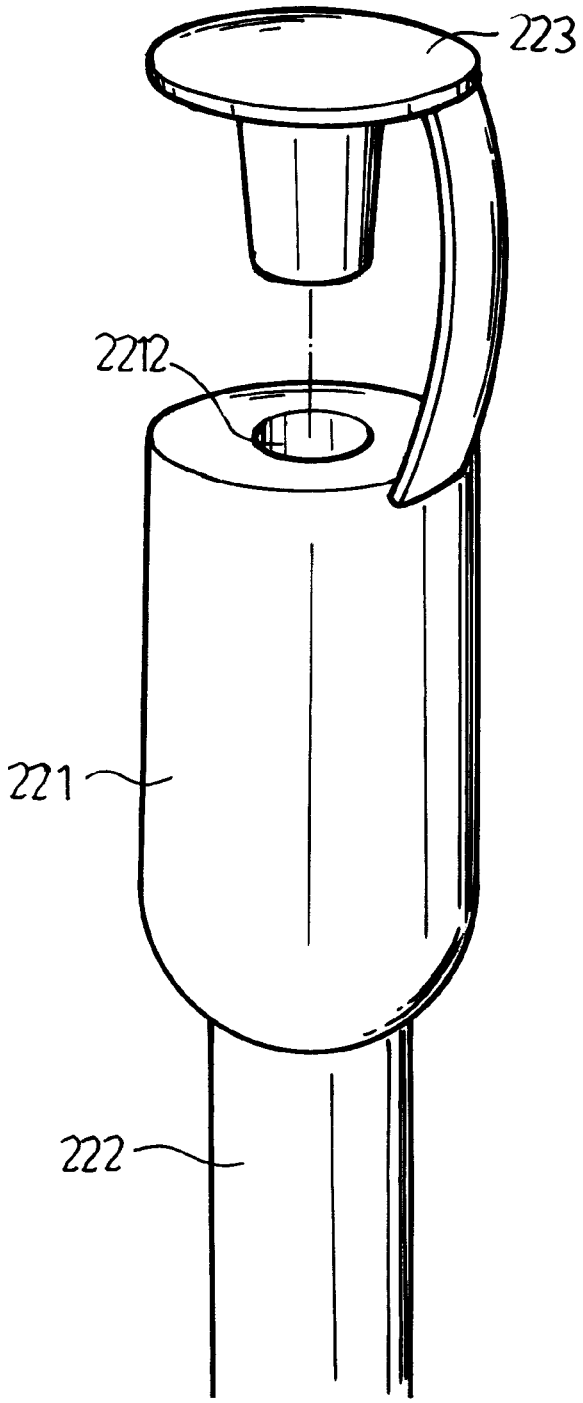
FIG. 4 is an elevational view of an alternate form of the air inlet tube according to the present invention.

FIG. 4 shows an alternate form of the air inlet tube. According to this alternate form, the air inlet tube comprises a tube 222, a mouthpiece 221 integral with one end of the tube 222 and defining a longitudinal blowhole 2212, and a stopper 223 hinged to the mouthpiece 221 and adapted to seal the blowhole 2212.

Figure 5:
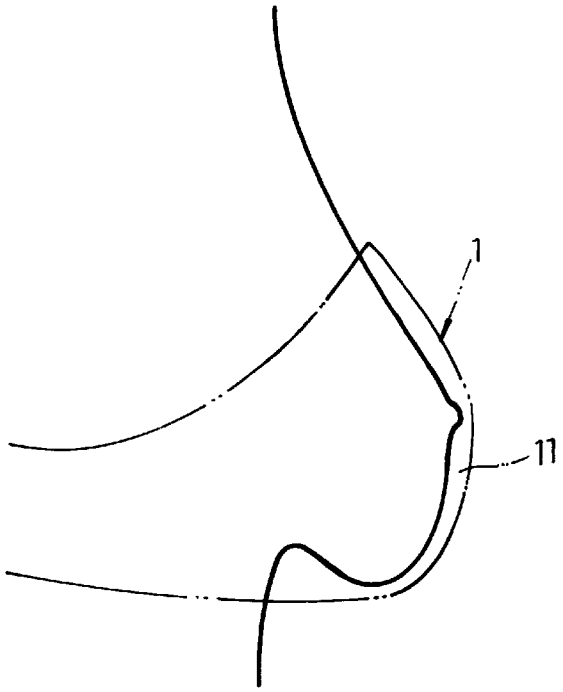
FIG. 5 is a schematic drawing showing the falling status of a breast.
Figure 6:
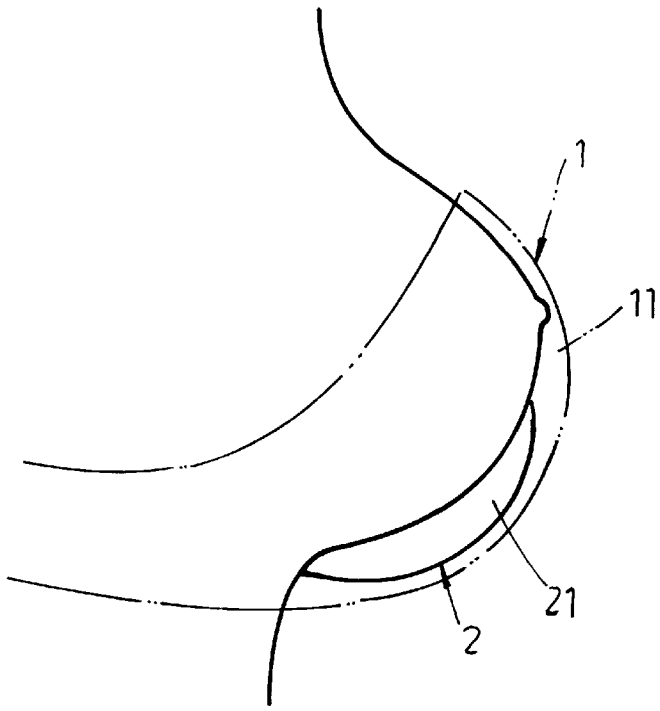
FIG. 6 illustrates the falling breast lifted after the application of the present invention.
Figure 7:
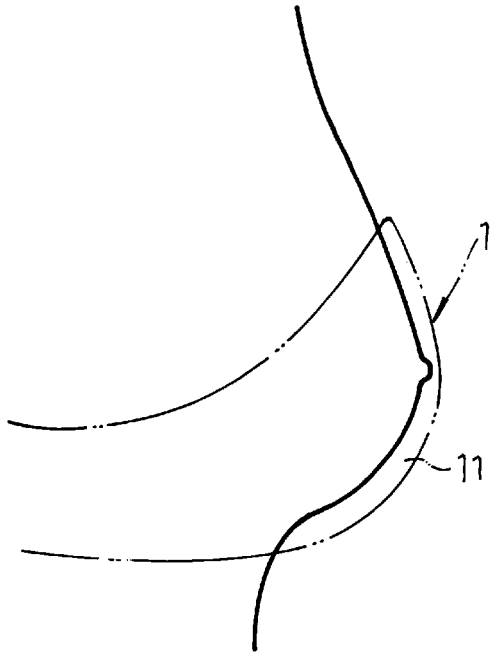
FIG. 7 is a schematic drawing showing a flat breast.
Figure 8:
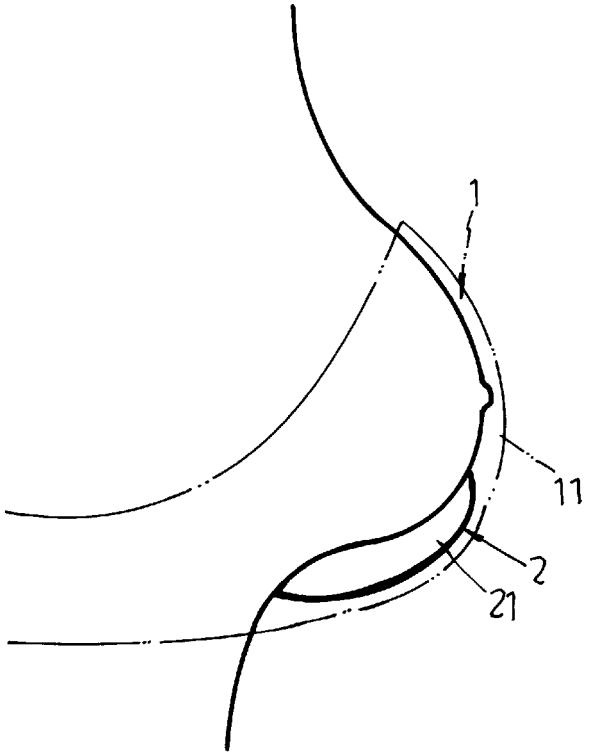
FIG. 8 illustrates the appearance of the flat breast enhanced after the application of the present invention.

Referring to FIGS. from 5 through 8, when in use, air is blown through the mouthpiece 221 into the tube 222 to inflate the flat inflatable paddings 21. The inflated status of the inflatable paddings 21 can be adjusted subject to one's need. When worn over the breasts, the inflated inflatable paddings 21 lifts the falling breasts upwards (see FIGS. 5 and 6), or enhances the appearance of the breasts (see FIGS. 7 and 8).

Figure 9:
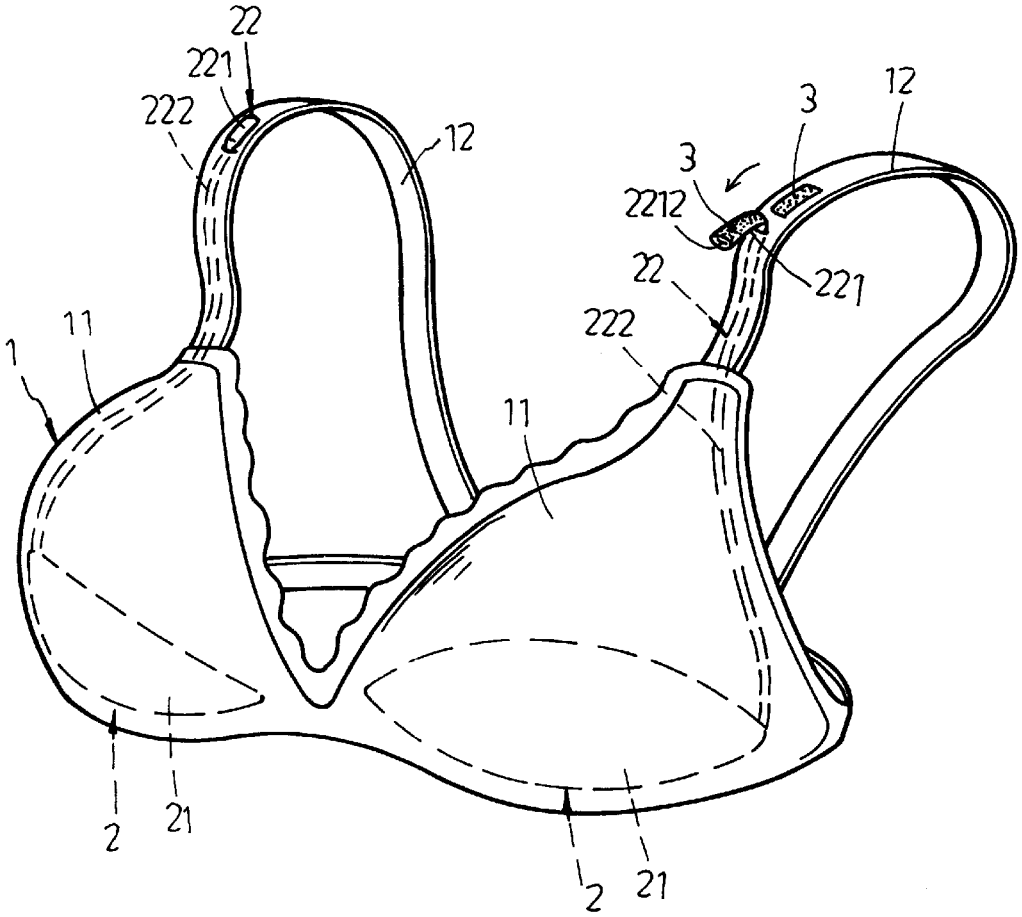
FIG. 9 shows an alternate form of the brassiere according to the present invention.

FIG. 9 shows an alternate form of the present invention. According to this alternate form, the inflatable paddings 21 are independently installed in the cups 11 of the brassiere body 1, and two air inlet tubes 22 are respectively fastened to the shoulder straps 12 of the brassiere body 1 and connected to the inflatable paddings 21. This alternate form enables the inflatable paddings 21 to be separately inflated. By means of the application of the present invention, the user can increase the cup sizes from A to B, C, D or E as desired.

Figure 10:
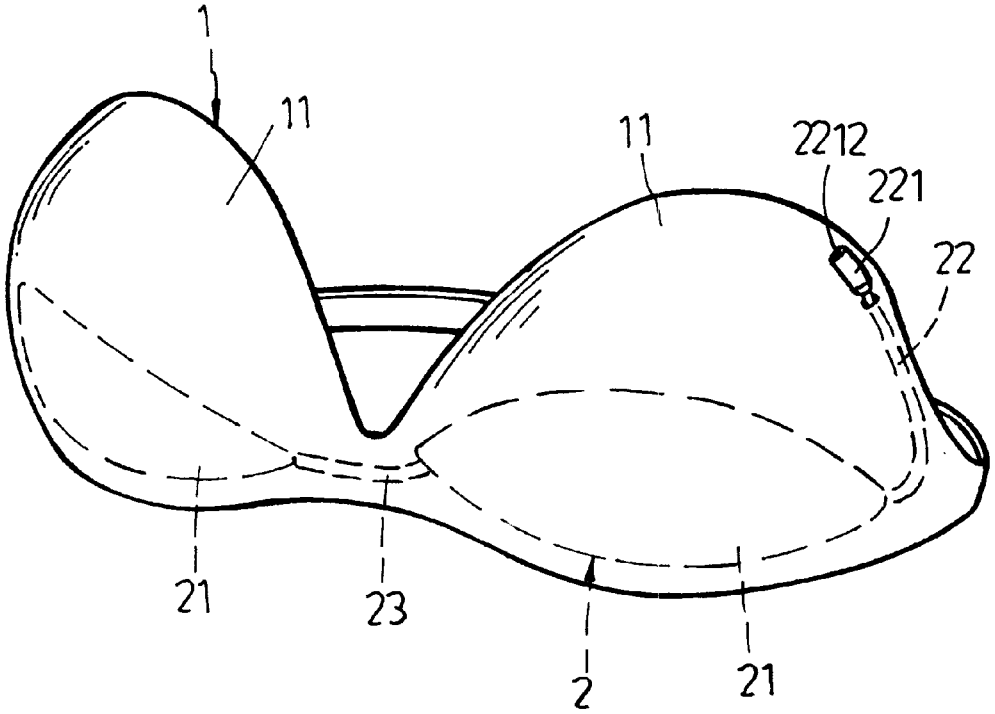
FIG. 10 shows another alternate form of the brassiere according to the present invention.

Referring to FIG. 10, the invention can also be used in a strapless brassiere. According to this alternate form, the air inlet tube 22 is arranged along the border area of one cup 11 of the brassiere body 1.

Figure 11:
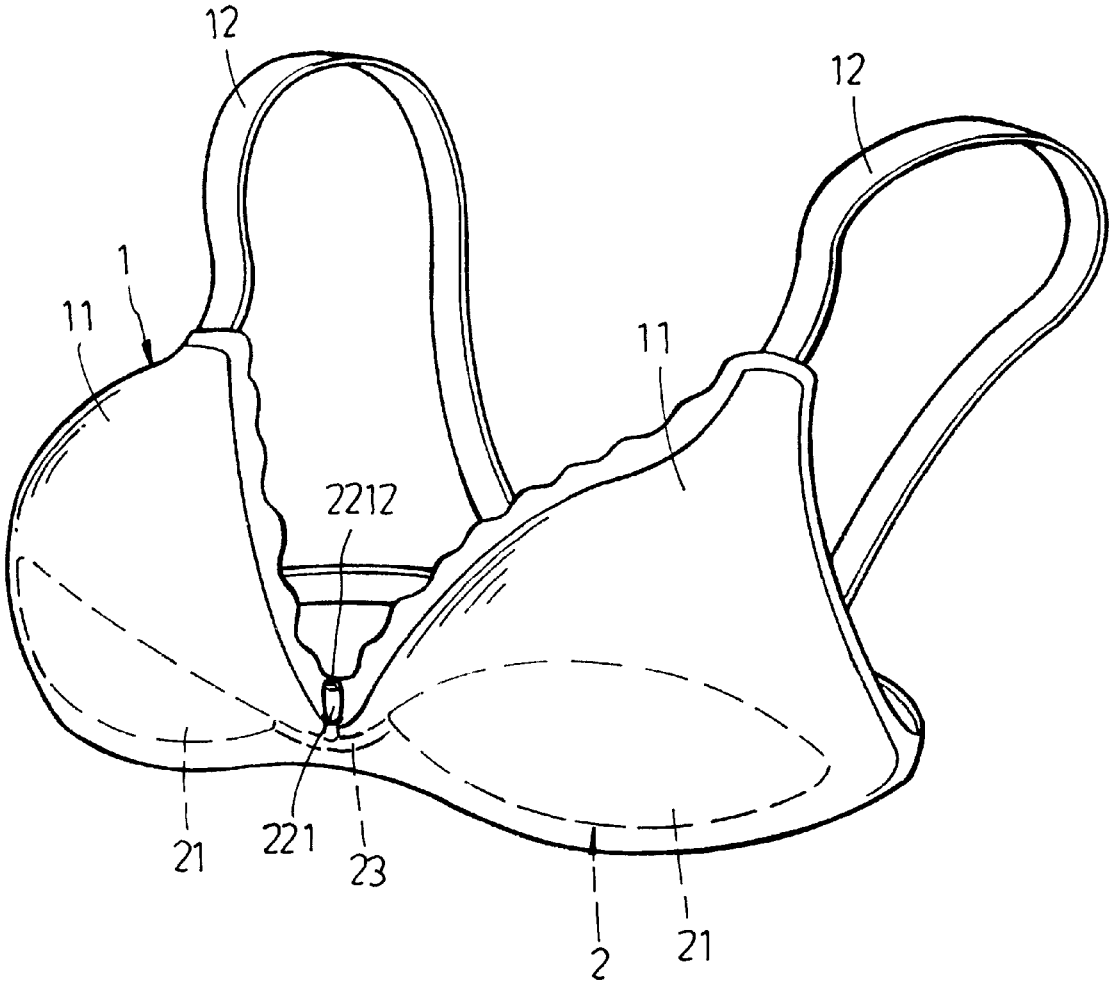
FIG. 11 shows still another alternate form of the brassiere according to the present invention.

FIG. 11 shows still another alternate form of the present invention. According to this alternate form, the mouthpiece 221 is directly formed integral with the connecting tube 23.

It is to be understood that the drawings are designed for purposes of illustration only, and are not intended for use as a definition of the limits and scope of the invention disclosed. For example, a hand pump may be installed for operation by hand to pump air into the air inlet tube.

What the invention claimed is:

1. A brassiere comprising two inflatable paddings respectively installed in two cups of a brassiere body thereof, at least one air inlet tube installed in the brassiere body and adapted for blowing air to inflate said inflatable paddings, wherein said at least one air inlet tube each comprises a tube body, and a mouthpiece coupled to said tube body and moved axially relative to said tube body between a first position where said tube body is closed and a second position where said tube body is opened and air is allowed to be driven into said tube body through said mouthpiece, said tube body having one end connected to one of said inflatable paddings and an opposite end terminating in an enclosed conical endpiece, said conical endpiece having two air inlets bilaterally disposed at a top side thereof, said mouthpiece comprising center conical coupling chamber, which receives the conical endpiece of said tube body, and a blowhole longitudinally extended through said conical coupling chamber.

2. The brassiere of claim 1 further comprising a connecting tube connected between said inflatable paddings.

3. The brassiere of claim 1 further comprising hook and loop materials adapted to secure said at least one air inlet tube to shoulder straps of the brasierre body.

4. The brassiere of claim 1 wherein said at least one air inlet tube each is arranged along the border area of one cup of the brassiere body.

* * * * *